US010288310B2

(12) United States Patent
Nakamura

(10) Patent No.: US 10,288,310 B2
(45) Date of Patent: May 14, 2019

(54) CEILING-EMBEDDED AIR CONDITIONER WITH WINDBREAK RIBS

(71) Applicant: FUJITSU GENERAL LIMITED, Kawasaki-shi, Kanagawa-ken (JP)

(72) Inventor: Yuta Nakamura, Kawasaki (JP)

(73) Assignee: FUJITSU GENERAL LIMITED, Kawasaki-Shi, Kanagawa-Ken (JP)

( * ) Notice: Subject to any disclaimer, the term of this patent is extended or adjusted under 35 U.S.C. 154(b) by 366 days.

(21) Appl. No.: 15/081,003

(22) Filed: Mar. 25, 2016

(65) Prior Publication Data

US 2016/0313021 A1 Oct. 27, 2016

(30) Foreign Application Priority Data

Apr. 27, 2015 (JP) ..... 2015-090274

(51) Int. Cl.

| | |
|---|---|
| ***F24D 5/10*** | (2006.01) |
| ***F24F 13/14*** | (2006.01) |
| ***F24F 1/0022*** | (2019.01) |
| ***F24F 13/30*** | (2006.01) |
| ***F24F 13/20*** | (2006.01) |
| ***F24F 1/0014*** | (2019.01) |
| ***F24F 13/22*** | (2006.01) |
| ***F24F 11/30*** | (2018.01) |
| ***F24F 11/79*** | (2018.01) |

(Continued)

(52) U.S. Cl.

CPC ..... *F24F 13/14* (2013.01); *F24F 1/0014* (2013.01); *F24F 1/0022* (2013.01); *F24F 11/30* (2018.01); *F24F 11/79* (2018.01); *F24F 11/89* (2018.01); *F24F 13/20* (2013.01); *F24F 13/22* (2013.01); *F24F 13/30* (2013.01); *F01P 11/10* (2013.01); *F24F 2001/0037* (2013.01); *F24F 2013/0616* (2013.01); *F24F 2120/10* (2018.01); *F24F 2120/12* (2018.01)

(58) Field of Classification Search

CPC ..... F24F 1/0022; F24F 1/0014; F24F 1/0007; F24F 13/14; F24F 11/30; F01P 11/10; F01P 11/89

USPC ..... 165/53

See application file for complete search history.

(56) References Cited

U.S. PATENT DOCUMENTS

2004/0050077 A1* 3/2004 Kasai ..... F24F 1/0011 62/186

FOREIGN PATENT DOCUMENTS

JP 4052264 B2 2/2008
JP 2011174693 A * 9/2011 ..... F24F 1/0014

(Continued)

OTHER PUBLICATIONS

Translation of JP 2011174693 A entilted Translation—JP 2011174693 A.*

*Primary Examiner* — Paul Alvare
(74) *Attorney, Agent, or Firm* — Manabu Kanesaka

(57) ABSTRACT

A ceiling-embedded air conditioner includes: a decorative panel; a turbo fan; a heat exchanger; an air suction path; air blowoff paths; an air suction opening and air blowoff openings that are provided in the decorative panel; corner panels disposed at corner portions between the adjacent air blowoff openings; a human sensor that is provided on a specific corner panel; a wind guide path that flows conditioned air blown from the air blowoff openings; and windbreak ribs that are erected from the specific corner panel to suppress direct strike, on the human sensor, of the conditioned air flowing from the wind guide path to the specific corner panel.

7 Claims, 8 Drawing Sheets

(51) Int. Cl.

| | |
|---|---|
| ***F24F 11/89*** | (2018.01) |
| *F24F 1/00* | (2019.01) |
| *F01P 11/10* | (2006.01) |
| *F24F 13/06* | (2006.01) |
| *F24F 120/10* | (2018.01) |
| *F24F 120/12* | (2018.01) |

(56) References Cited

FOREIGN PATENT DOCUMENTS

| | | | | | |
|---|---|---|---|---|---|
| JP | 2011-257112 | A | | 12/2011 | |
| WO | WO 2010074496 | A2 | * | 7/2010 | ..... F24F 1/0007 |
| WO | WO 2011099608 | A1 | * | 8/2011 | ..... F24F 1/0014 |
| WO | WO 2014162975 | A1 | * | 10/2014 | ..... F24F 1/0014 |

* cited by examiner

CEILING-EMBEDDED AIR CONDITIONER WITH WINDBREAK RIBS

CROSS-REFERENCE TO RELATED APPLICATION

This application claims priority from Japanese Patent Application No. 2015-090274 filed with the Japan Patent Office on Apr. 27, 2015, the entire content of which is hereby incorporated by reference.

BACKGROUND

1. Technical Field

The present disclosure relates to a ceiling-embedded air conditioner that is embedded in a space between a ceiling slab and a ceiling panel. More specifically, the present disclosure relates to a ceiling-embedded air conditioner that has a blowoff structure blowing conditioned air from air blowoff openings toward all directions.

2. Description of the Related Art

In a ceiling-embedded air conditioner, a box-shaped casing main body is embedded in a space formed between a ceiling slab and a ceiling panel. A square decorative panel is mounted on the lower surface (facing the interior of a room) of the casing main body. In general, an air suction opening is provided in the center of the decorative panel, and air blowoff openings are provided around the air suction opening. The casing main body includes a turbo fan, a heat exchanger surrounding the outer periphery of the turbo fan, and a drain pan disposed under the heat exchanger (for example, refer to Japanese Patent No. 4052264).

In conventional ceiling-embedded air conditioners, however, the air blowoff openings are at four places along the four sides of the decorative panel. The conditioned air having undergone heat exchange is blown from the four sides of the decorative panel but is not blown from the four corners (corner portions). This easily causes uneven room temperatures.

Accordingly, the ceiling-embedded air conditioner disclosed in Japanese Patent No. 4052264, air blowoff paths are provided along the entire circumference of the drain pan in the casing. Further, auxiliary blowoff openings are provided at the corner portions of the decorative panel to connect the adjacent ends of the air blowoff openings. Accordingly, the air blowoff openings are disposed in an octagonal ring shape as a whole. This makes it possible to blow air in all directions.

In addition, there has been recently proposed a ceiling-embedded air conditioner with a human sensor (also called human detection sensor) detecting the presence or absence of a human at part of the decorative panel as one of energy-saving measures (for example, refer to JP-A-2011-257112). According to this technique, the air conditioner is stopped or operated at low power in the absence of a human in the sensor monitoring area. This reduces power consumption.

SUMMARY

A ceiling-embedded air conditioner includes: a casing main body embedded in a ceiling; a square decorative panel mounted on the bottom surface of the casing main body; a turbo fan disposed in the casing main body; a heat exchanger disposed in the casing main body to surround the outer periphery of the turbo fan; a drain pan disposed in the casing main body along the side under the heat exchanger; an air suction path that is disposed in the center of the drain pan and reaches the turbo fan; an air blowoff path for conditioned air having passed through the heat exchanger, the air blowoff path being provided at four places along the sides of a virtual square surrounding the air suction path; an air suction opening that is provided in the decorative panel and communicates with the air suction path; an air blowoff opening that is provided in the decorative panel and communicates with the air blowoff path; a corner panel that is disposed at a corner portion between the adjacent air blowoff openings; a human sensor for detecting a human body that is exposed at a specific corner panel of the corner panels; a wind guide path that is provided in the decorative panel to flow part of the conditioned air blown from the air blowoff opening to between ends of the adjacent air blowoff openings toward the corner panel; and windbreak ribs that are erected from the specific corner panel to suppress direct strike, on the human sensor, of the conditioned air flowing from the wind guide path toward the specific corner panel.

DESCRIPTION OF THE EMBODIMENTS

Figure 1:
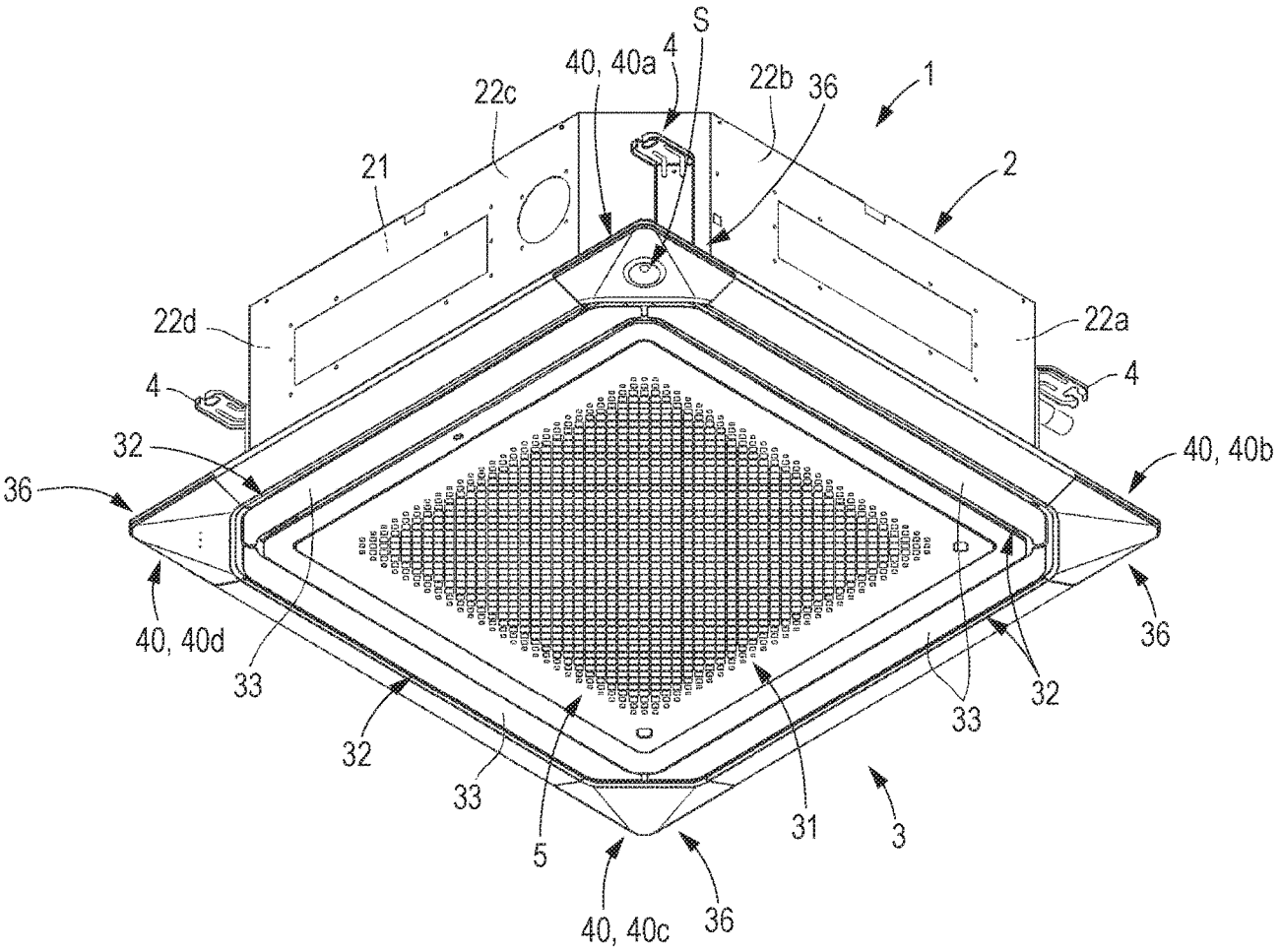
FIG. 1 is a perspective external view of a ceiling-embedded air conditioner according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The human sensor is generally a pyroelectric infrared sensor. If the human sensor described in JP-A-2011-257112 is applied as one of energy-saving measures to the omnidirectional ceiling-embedded air conditioner described in JP No. 4052264, there are causes for concerns as described below.

Specifically, in the omnidirectional ceiling-embedded air conditioner, the conditioned air also flows into the corner portions of the decorative panel. Accordingly, the conditioned air strikes directly the human sensor at the corner portion. When the hot or cool air strikes directly the human sensor but the temperature is not changed, the human sensor does not malfunction. However, when the wind direction plates move at the start of operation or during operation, the conditioned air may strike the human sensor in different ways to cause the human sensor to malfunction.

An object of the present disclosure is to provide an omnidirectional ceiling-embedded air conditioner as described below. The ceiling-embedded air conditioner suppresses direct strike of the conditioned air on a human sensor at a corner portion of a decorative panel to suppress malfunction of the human sensor.

A ceiling-embedded air conditioner according to an aspect of the present disclosure (the present air conditioner) includes: a casing main body embedded in a ceiling; a square decorative panel mounted on the bottom surface of the casing main body; a turbo fan disposed in the casing main body; a heat exchanger disposed in the casing main body to surround the outer periphery of the turbo fan; a drain pan disposed in the casing main body along the side under the heat exchanger; an air suction path that is disposed in the center of the drain pan and reaches the turbo fan; an air blowoff path for conditioned air having passed through the heat exchanger, the air blowoff path being provided at four places along the sides of a virtual square surrounding the air suction path; an air suction opening that is provided in the decorative panel and communicates with the air suction path; an air blowoff opening that is provided in the decorative panel and communicates with the air blowoff path; a corner panel that is disposed at a corner portion between the adjacent air blowoff openings; a human sensor for detecting a human body that is exposed at a specific corner panel of the corner panels; a wind guide path that is provided in the decorative panel to flow part of the conditioned air blown from the air blowoff opening to between ends of the adjacent air blowoff openings toward the corner panel; and windbreak ribs that are erected from the specific corner panel to suppress direct strike, on the human sensor, of the conditioned air flowing from the wind guide path toward the specific corner panel.

In a more preferable aspect, the windbreak rib is triangular in cross section and is formed continuously along a boundary portion between the specific corner panel and the wind guide path, and the windbreak rib includes: a vertical surface that is raised at a predetermined height from a panel surface of the specific corner panel; and an inclined surface that is inclined from a peak portion of the vertical surface toward a leading end portion of the specific corner panel.

In a further more preferable aspect, the specific corner panel is formed such that its thickness becomes smaller from a base end portion toward a leading end portion on the wind guide path side, and the windbreak rib is disposed nearer the base end portion than the leading end portion of the specific corner panel.

In another aspect, the specific corner panel has a sensor housing concave portion in which the human sensor is disposed, the sensor housing concave portion being formed at a predetermined depth from the panel surface in a predetermined position between a base end portion and the leading end portion of the specific corner panel, and the second windbreak rib is erected around the sensor housing concave portion to suppress direct strike, on the human sensor, of the conditioned air flowing from the wind guide path toward the specific corner panel.

In a more preferable aspect, the second windbreak rib is an annular convex portion formed continuously along the edge of the sensor housing concave portion.

The present air conditioner avoids airflows from the wind guide path to the specific corner panel striking directly the human sensor. This suppresses malfunction of the human sensor.

Next, an embodiment of the present disclosure will be described with reference to the drawings. However, the technique of the present disclosure is not limited to this.

Figure 2:
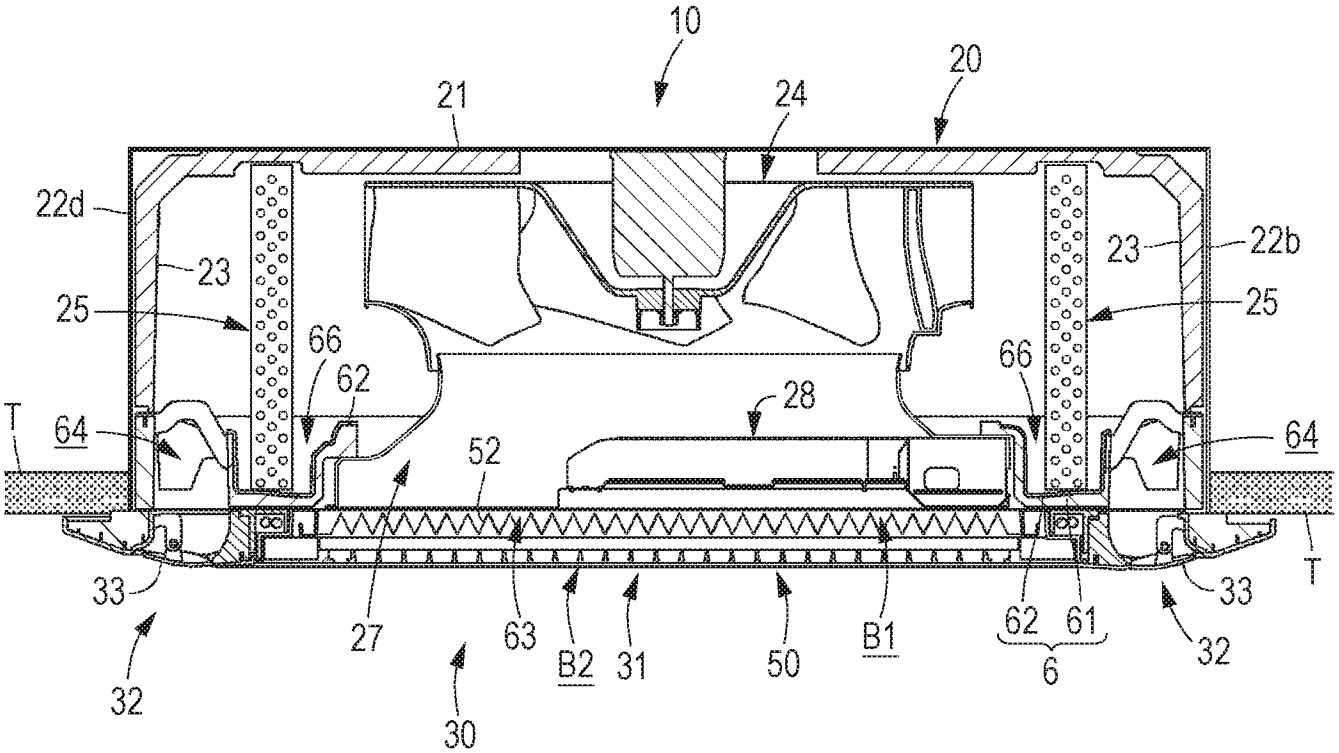
FIG. 2 is a cross-sectional view of main components of the ceiling-embedded air conditioner.
Figure 3:
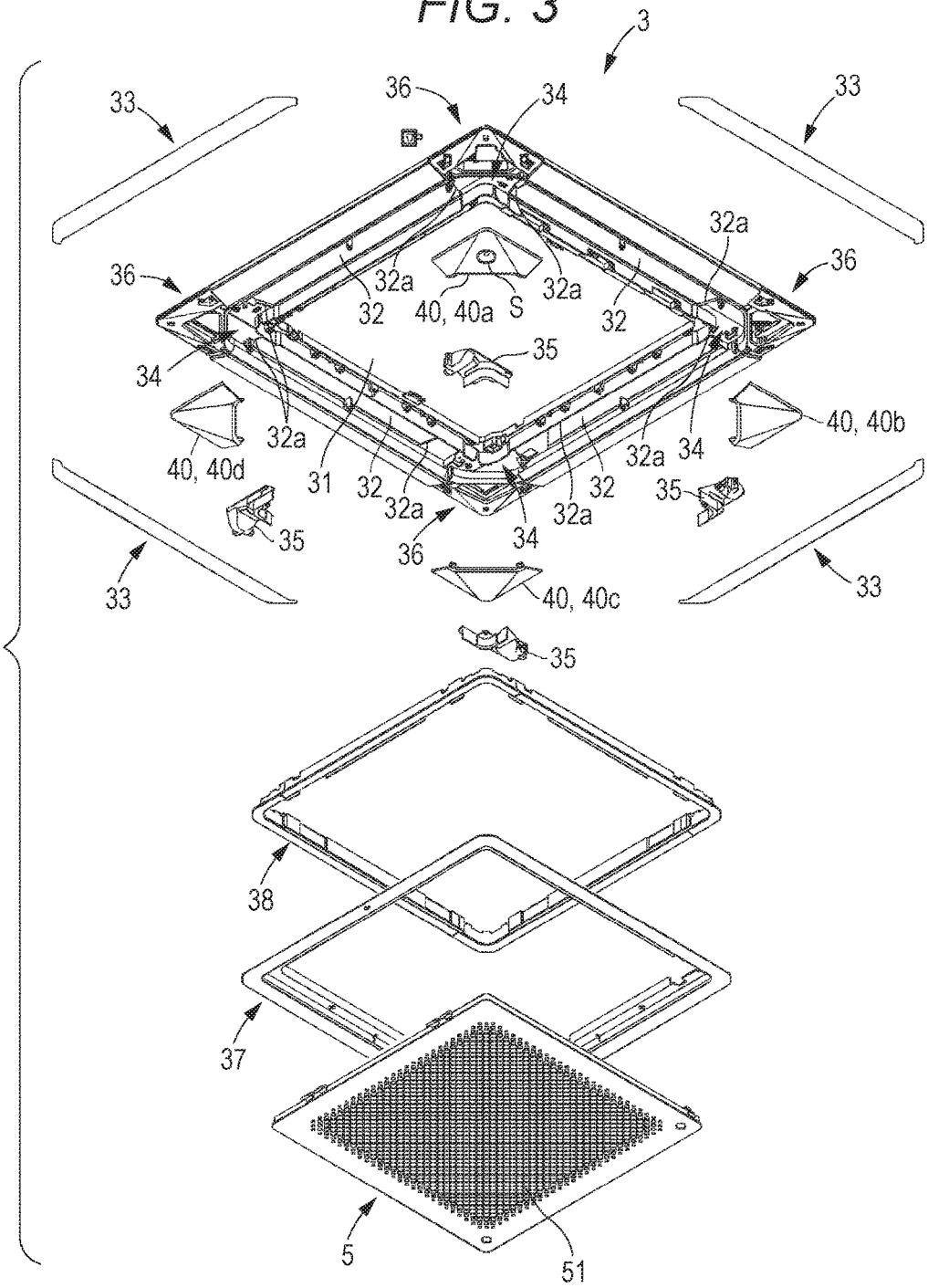
FIG. 3 is an exploded perspective view of a decorative panel seen from the bottom side.
Figure 4A:
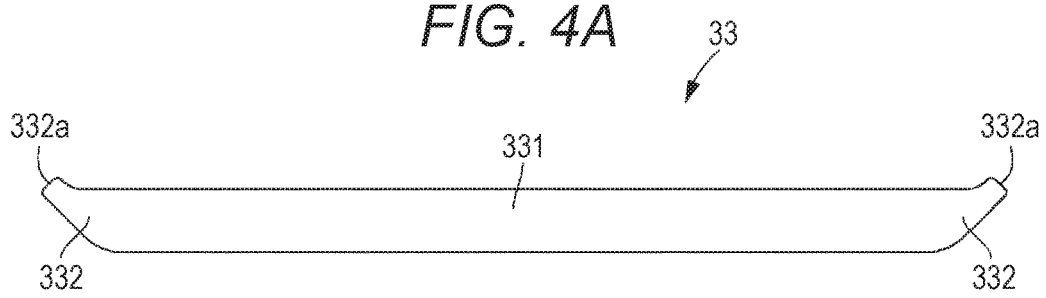
FIG. 4A is a front view of a wind direction plate.
Figure 4B:
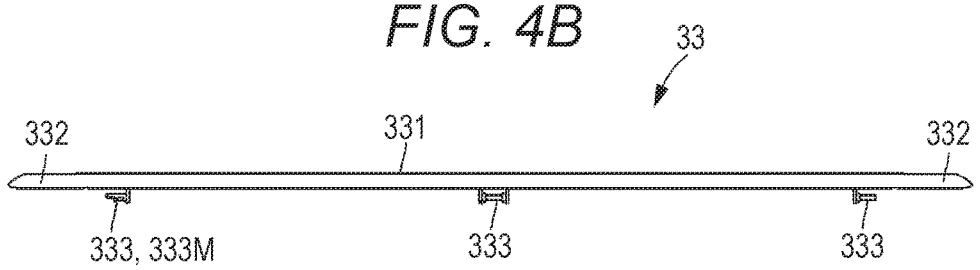
FIG. 4B is a plane view of the wind direction plate.
Figure 4C:
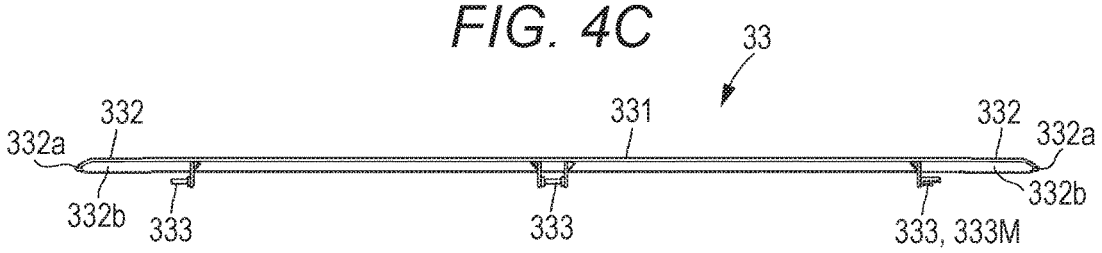
FIG. 4C is a bottom view of the wind direction plate.
Figure 4D:
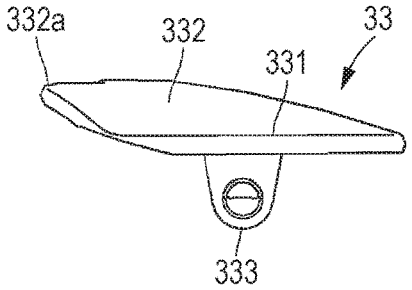
FIG. 4D is a left side view of the wind direction plate.
Figure 4E:
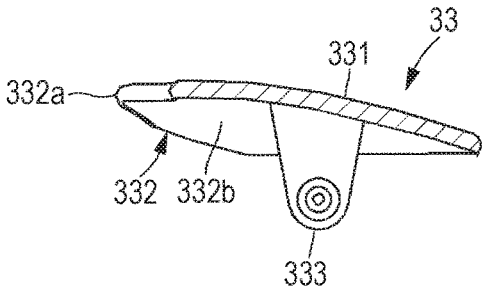
FIG. 4E is a vertical section-view of the wind direction plate in the middle.

As illustrated in FIGS. 1 and 2, a ceiling-embedded air conditioner 1 includes a cuboidal casing main body 2 and a decorative panel 3. The casing main body 2 is embedded in the ceiling. Specifically, the casing main body 2 is housed in a space formed between a ceiling slab and a ceiling panel T. The decorative panel 3 is mounted on a bottom surface B1 of the casing main body 2.

The casing main body 2 is a box-shaped container. The casing main body 2 has a square top plate 21 and four side plates 22 (22*a* to 22*d*) extending downward from the sides of the top plate 21. The bottom surface B1 (bottom surface in FIG. 1) of the casing main body 2 is opened. A heat insulator 23 made of foamed polystyrene is provided on the inner peripheral surface of the casing main body 2.

Hanging metal brackets 4 are provided at the four corner portions of the casing main body 2. When the hanging metal brackets 4 are locked to hanging bolts not illustrated hung from the ceiling, the ceiling-embedded air conditioner 1 is hung from and fixed to the ceiling.

As illustrated in FIG. 2, a turbo fan 24 as an air blower is disposed in almost the center of inside of the casing main body 2. A heat exchanger 25 is disposed in a square frame shape, for example, on the outer periphery of the turbo fan 24 to surround the turbo fan 24.

A drain pan 6 is disposed along the side under the heat exchanger 25 to receive dew condensation water generated by the heat exchanger 25 during cooling operation. In the embodiment, the drain pan 6 is made of a foamed polystyrene resin. The drain pan 6 includes a drain pan main body 61 having a dew receiving portion 66 and air blowoff paths 64. The air blowoff paths 64 guide the conditioned air having passed through the heat exchanger 25 to air blowoff openings 32 of the decorative panel 3. A hard resin drain sheet 62 serving also as a reinforcement material is disposed on the surface of the dew receiving portion 66 (opposed to the heat exchanger 25) of the drain pan main body 61.

The drain pan 6 has a square frame shape in a plane view. The inside of the square frame of the drain pan 6 constitutes an air suction path 63 communicating with an air suction opening 31 of the decorative panel 3. A bell mouth 27 is provided in the air suction path 63. The bell mouth 27 guides the air sucked from the air suction opening 31 toward the suction side of the turbo fan 24. That is, the air suction path 63 is a path that is disposed in the center of the drain pan 6 and reaches the turbo fan 24. An electric equipment box 28 is provided at part of the bell mouth 27 on the air suction opening 31 side.

Also referring to FIGS. 3 and 4A to 4E, the decorative panel 3 is a square flat frame body screwed into the bottom surface B1 of the casing main body 2. The decorative panel 3 has the square air suction opening 31 opened in the center and communicating with the air suction path 63. The rectangular air blowoff openings 32 communicating with the air blowoff paths 64 are disposed at four places along the four sides of the air suction opening 31. A suction grill 5 is detachably attached to the air suction opening 31.

The suction grill 5 is a synthetic resin molded article having a large number of suction holes 51. A dedusting filter 52 is held on the back surface of the suction grill 5. In the embodiment, the suction grill 5 is mounted on the decorative panel 3 via a suction grill frame 37 to which a heat insulating member 38 made of foamed polystyrene is attached.

The air blowoff openings 32 penetrate through the decorative panel 3 in the up-down direction and are opened in a rectangular shape. The air blowoff openings 32 are disposed along the sides of a virtual square Q (shown by the two-dot chain line in FIG. 5) to surround the four sides of the air suction opening 31.

The air blowoff openings 32 have end portions 32*a* opposed to each other at the four corner portions 36. Wind guide paths 34 are provided at the four corner portions 36. The wind guide paths 34 guide part of the air blown from the adjacent air blowoff openings 32 to the corner portions 36 of the decorative panel 3. The wind guide paths 34 are concave grooves that are recessed inward by one step from the surface (bottom surface) of the decorative panel 3. The wind guide paths 34 are formed in an L shape. In each of the wind guide paths 34, a portion 34*a* (see FIG. 6) extending from the end portion 32*a* of the one air blowoff opening 32 along a longitudinal axial line and a portion 34*a* extending from the end portion 32*a* of the other air blowoff opening 32 along a longitudinal axial line are coupled orthogonally to each other.

Wind direction plates 33 are rotatably disposed at the air blowoff openings 32. As illustrated in FIG. 4A to 4E, each of the wind direction plates 33 includes a straight-line portion 331 and inclined portions 332 and 332. The straight-line portion 331 is formed in a linear shape suited to the shape of the air blowoff opening 32. The inclined portions 332 and 332 are integrated with the straight-line portion 331 on the both ends of the straight-line portion 331 to correspond to the wind guide path 34.

The straight-line portion 331 is formed such that the front side (the upper side in FIG. 4E) has a gently curved convex surface and the back side (the lower side in FIG. 4E) has a gently curved concave surface suited to the front side.

The inclined portions 332 are formed in the same manner as the straight-line portion 331 such that the front side has a convex surface and the back side has a concave surface. The concave surface on the back side is formed such that the air is guided to from the base end side to tips 332*a* of the inclined portions 332.

Each of the wind direction plates 33 has rotation shafts 333 for the wind direction plate 33 on the back side thereof. In the embodiment, the rotation shafts 333 are coaxially provided at three places of the straight-line portion 331, the right and left ends and the middle.

Two of the three rotation shafts 333 (the right and middle rotation shafts 333 in FIG. 4B) are locked in bearing portions not illustrated on the decorative panel 3. The remaining one rotation shaft 333 (the left rotation shaft 333M in FIG. 4B in this example) is connected to a rotation drive shaft of a stepping motor 35 (see FIG. 3) described later.

The wind direction plates 33 are rotated by stepping motors 35. At the time of shutdown, the wind direction plates 33 rotate horizontally along the air blowoff openings 32 to close the air blowoff openings 32. At that time, the inclined portions 332 of the adjacent wind direction plates 33 are brought into abutment with each other. Accordingly, the wind guide paths 34 are also closed.

Figure 6:
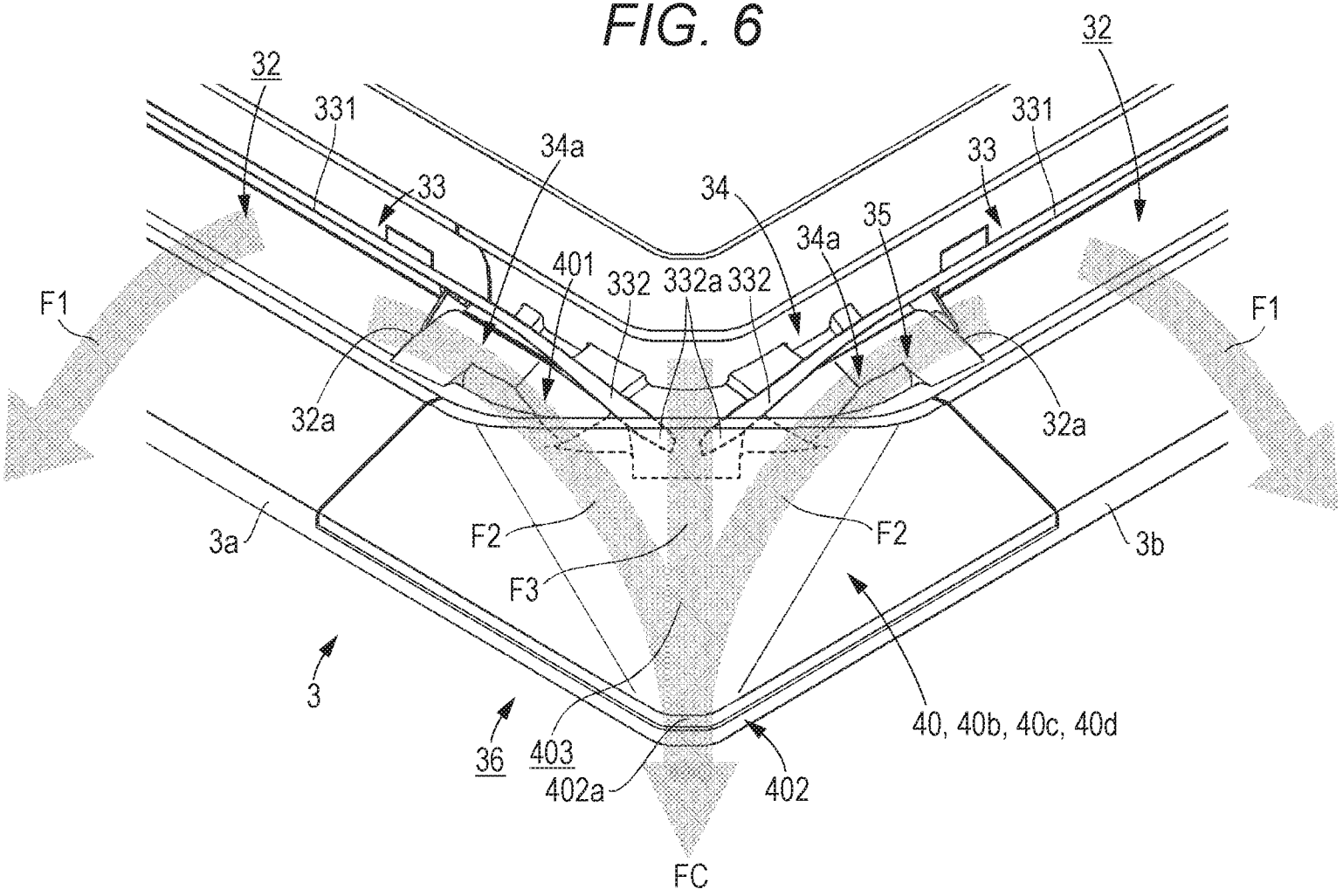
FIG. 6 is a perspective enlarged view of a corner portion illustrated in FIG. 5.
Figure 7:
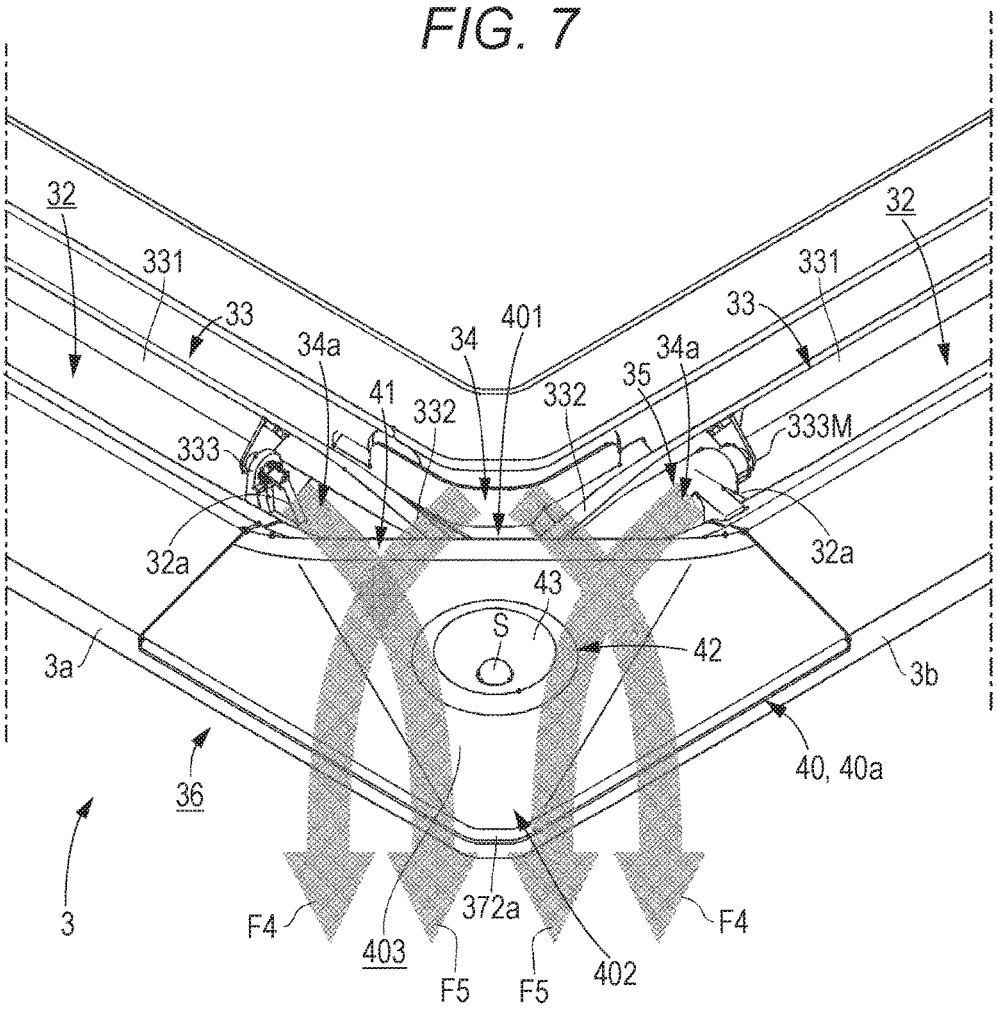
FIG. 7 is an enlarged perspective view of a specific corner panel having a human sensor.

During operation, the wind direction plates 33 rotate according to the operation status. Accordingly, the air blowoff openings 32 appear on a bottom surface B2 of the decorative panel 3. As illustrated in FIGS. 6 and 7, most of the air blown from the air blowoff openings 32 is guided along the surfaces of the straight-line portions 331 of the wind direction plates 33 and is blown from the four directions (arrows F1) toward the interior of the room at a predetermined blowoff angle.

Part of the air blown from the end portion 32*a* of the air blowoff opening 32 and its neighborhood form bidirectional airflows: airflows (arrows F2) blown from the tips 332*a* to the corner portion 36 along the inner peripheral surface 332*b* of the inclined portions 332 of the wind direction plate 33; and an airflow (arrow F3) blown to the corner portion 36 through the wind guide path 34. These airflows combine into one airflow (arrow FC). The airflow is blown from the four corner portions 36 of the decorative panel 3 toward the interior of the room.

Figure 5:
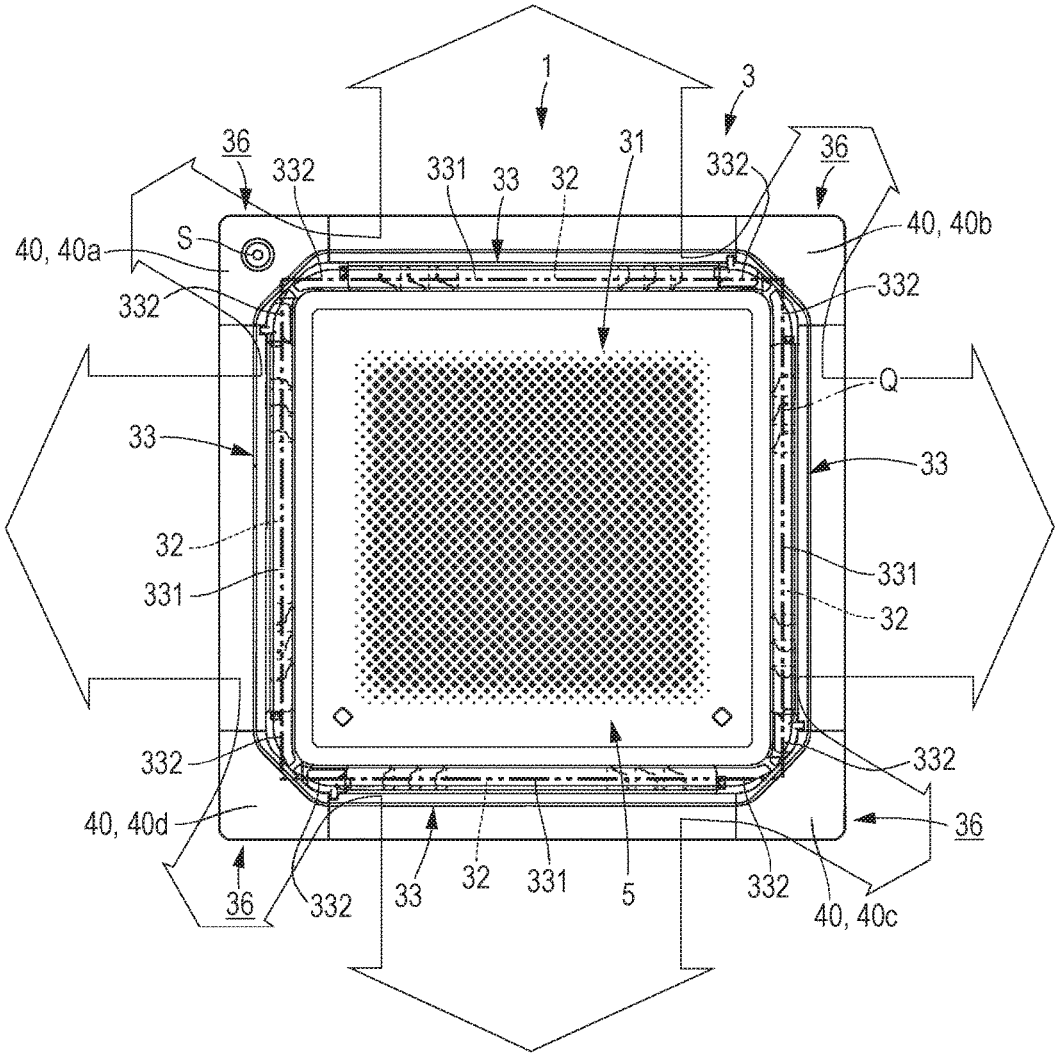
FIG. 5 is a front view of the ceiling-embedded air conditioner seen from the bottom side (ceiling panel side) with the wind direction plates opened during operation.

In this manner, as illustrated in FIG. 5, the conditioned air is blown in all directions (total eight directions) including the four directions from the sides of the decorative panel 3 and the four directions from the four corner portions 36.

Corner panels 40 (40*a*, 40*b*, 40*c*, and 40*d*) are provided at the four corner portions 36 of the decorative panel 3. The corner panels 40*a*, 40*b*, 40*c*, and 40*d* have almost the same basic shape. In the following description, the expression "corner panel 40" will be used to explain the common configuration of the corner panels. Meanwhile, the expression "corner panels 40*a*, 40*b*, 40*c*, and 40*d*" will be used to explain the different configurations of the corner panels to discriminate among the corner panels.

As illustrated in FIG. 7, the corner panel 40 is an almost triangular resin panel, and is screwed into the corner portion surrounded by adjacent outer peripheral sides 3*a* and 3*b* of the square decorative panel 3 and the wind guide path 34. The corner panel 40 is formed such that its thickness becomes gradually smaller from a base end portion 401 side (wind guide path 34 side) to a leading end portion 402*a* side (outer peripheral sides 3*a* and 3*b*).

A panel surface 403 of the corner panel 40 is an inclined surface with a descending slope relative to the ceiling panel T from the base end portion 401 to the outer peripheral portion 402. According to this, the entire decorative panel 3 looks thin to improve appearance. Further, the airflow having sent to the base end portion 401 of the corner panel 40 through the wind direction plate 33 and the wind guide path 34 is smoothly sent to the outer peripheral portion 402 along the panel surface 403 as surface of the corner panel 40.

A human sensor S for detecting the presence or absence of a human body is provided and exposed at one specific corner panel of the corner panels 40*a*, 40*b*, 40*c*, and 40*d* (in this example, the corner panel 40*a*).

Figure 8:
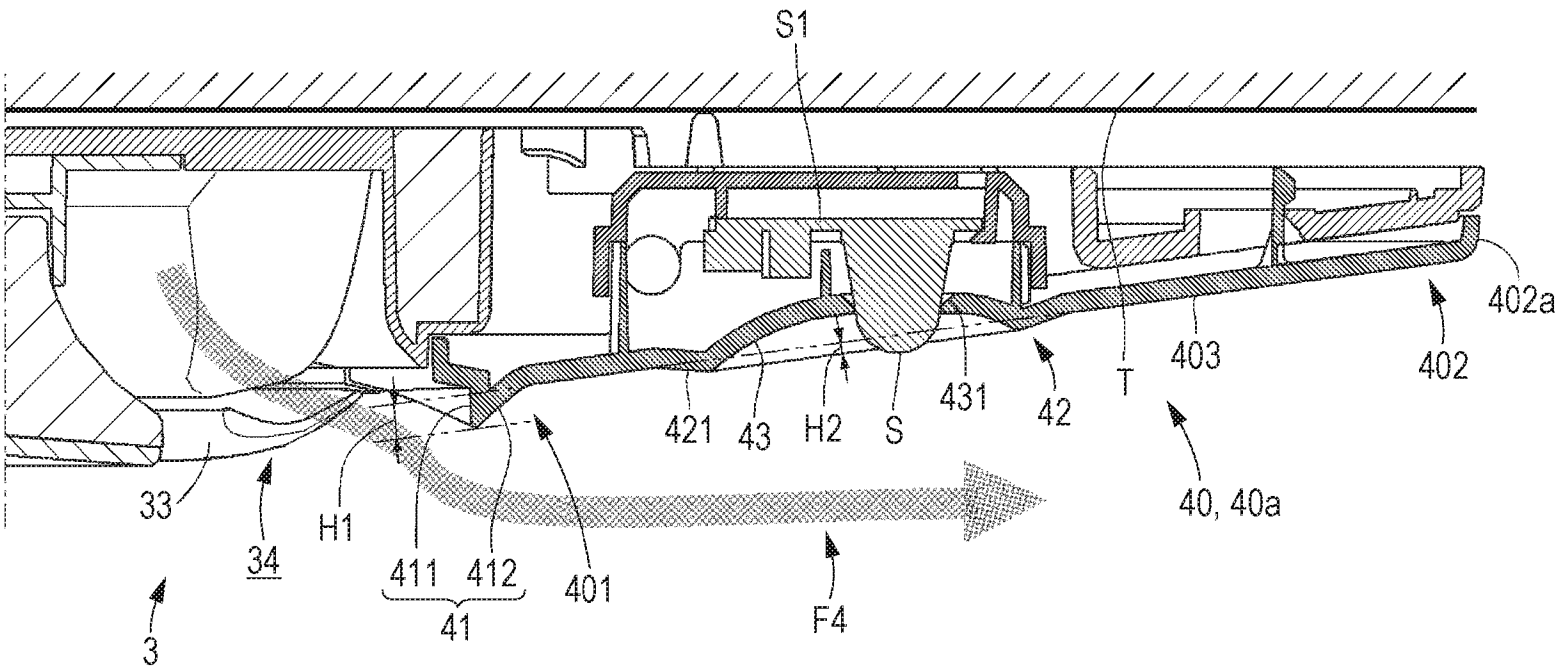
FIG. 8 is a partially enlarged cross-sectional view of the specific corner panel having the human sensor.

The human sensor S is a pyroelectric infrared sensor. As illustrated in FIG. 8, the human sensor S is mounted on a circuit substrate S1 disposed on the back surface of the corner panel 40*a* (opposite to the panel surface 403). A sensor housing concave portion 43 is provided in the panel surface 403 of the corner panel 40*a* to house the human sensor S.

The sensor housing concave portion 43 is a concave portion recessed by one step from the panel surface 403. The sensor housing concave portion 43 has in the bottom surface an insertion hole 431 for exposing the human sensor S in the sensor housing concave portion 43. In this example, the sensor housing concave portion 43 has a concave spherical surface in which the human sensor S is housed. In this manner, the corner panel 40*a* has the sensor housing concave portion 43. The sensor housing concave portion 43 is formed at a predetermined depth from the panel surface 403 in a predetermined position between the base end portion 401 and the leading end portion 402*a*.

The human sensor S is disposed on the corner panel 40*a*. Accordingly, when the corner panel 40*a* is the same in shape as the other corner panels 40*b*, 40*c*, and 40*d*, the airflows of the conditioned air flowing through the panel surface 403 come into direct contact with the human sensor S. Even though the hot or cool air strikes directly the human sensor S, the human sensor S does not malfunction when there is no temperature change. However, when the wind direction plates 33 move at the start of operation or during operation, the conditioned air may strike the human sensor S in different ways to cause the human sensor S to malfunction.

Accordingly, the corner panel 40*a* is provided with first and second windbreak ribs 41 and 42. The first and second windbreak ribs 41 and 42 are used to suppress direct strike, on the human sensor S, of the airflows (the conditioned air flowing toward the corner panel 40*a*). As illustrated in FIG. 8, the first windbreak rib 41 is disposed (erected) on the corner panel 40*a* nearer the base end portion 401 than the leading end portion 402*a*. The first windbreak rib 41 is triangular in cross section and formed continuously along the wind guide path 34 (a boundary portion between the corner panel 40*a* and the wind guide path 34). The first windbreak rib 41 includes a vertical surface 411 and an inclined surface 412. The vertical surface 411 is raised at a predetermined height from the panel surface 403 of the corner panel 40*a*. The inclined surface 412 inclines from the peak portion of the vertical surface 411 toward the leading end portion 402*a* of the corner panel 40*a*.

In the embodiment, the first windbreak rib 41 protrudes at a height H1 from the panel surface 403 of the corner panel 40*a*. The vertical surface 411 and the inclined surface 412 cross at an acute angle at a point of intersection between the vertical surface 411 and the inclined surface 412. The first windbreak rib 41 is effective against the airflows blown from the wind guide path 34 (arrows F4 illustrated in FIG. 7).

Specifically, the direction of the airflows (arrows F4) striking the vertical surface 411 of the first windbreak rib 41 is forcibly changed downward. This suppresses direct strike of the airflows on the human sensor S. Accordingly, it is possible to suppress malfunction of the human sensor S. The vertical surface 411 and the inclined surface 412 cross at an acute angle. Accordingly, it is also possible to suppress moving along the inclined surface 412 of the airflows having passed through the first windbreak rib 41.

The second windbreak rib 42 is an annular convex portion formed continuously along the outer peripheral edge of the concave spherical surface of the sensor housing concave portion 43. An outer peripheral surface 421 of the second windbreak rib 42 is an inclined surface with a larger inclination angle than the inclination angle of the panel surface 403 of the corner panel 40*a*.

In the embodiment, the second windbreak rib 42 protrudes at a height H2 from the panel surface 403 of the corner panel 40*a*. The second windbreak rib 42 is effective against the airflows that cannot be prevented only by the first windbreak rib 41. The airflows includes airflows (arrows F5 illustrated in FIG. 7) blown from the tips 332*a* to the corner portion 36 along the inner peripheral surface of the inclined portions 332 of the wind direction plate 33.

Specifically, the airflows (arrows F5 equivalent to arrows F2 illustrated in FIG. 6) blown from the tips 332*a* to the corner portion 36 along the inner peripheral surface 332*b* of the inclined portions 332 of the wind direction plate 33 is guided downward along the outer peripheral surface (inclined surface) 421 of the second windbreak rib 42. This suppresses direct strike of the airflows on the human sensor S. Accordingly, it is possible to suppress malfunction of the human sensor S.

In the embodiment, the pyroelectric infrared human sensor S is embedded in the sensor housing concave portion 43. The type and detection method of the human sensor S can be selected arbitrarily according to the specifications. Instead of the human sensor S, a light-receiving portion (reception portion) of a sensor unit such as a temperature sensor, a humidity sensor, or a remote control sensor inside the room may be disposed in the sensor housing concave portion 43.

In the embodiment, the sensor housing concave portion 43 is provided in the one specific corner panel 40*a*. The sensor housing concave portion 43 and the human sensor S may be provided at one or more of the four corner panels 40*a*, 40*b*, 40, and 40*d*. In addition, a plurality of sensor housing concave portions 43 may be provided in the panel surface 403 of the one corner panel 40*a* and various sensors may be disposed in the sensor housing concave portions 43.

As described above, according to the embodiment, it is possible to suppress direct strike, on the human sensor, of the airflows flowing from the wind guide path toward the specific corner panel. Accordingly, it is possible to suppress malfunction of the human sensor.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A ceiling-embedded air conditioner comprising:

a casing main body embedded in a ceiling;

a square decorative panel mounted on a bottom surface of the casing main body;

a turbo fan disposed in the casing main body;

a heat exchanger disposed in the casing main body to surround an outer periphery of the turbo fan;

a drain pan disposed in the casing main body along a bottom side of the heat exchanger;

an air suction path that is disposed on an interior side of the drain pan and reaches the turbo fan;

air blowoff paths for conditioned air having passed through the heat exchanger;

an air suction opening that is provided in the decorative panel and communicates with the air suction path;

air blowoff openings that are provided in the decorative panel, the air blowoff openings communicating with the air blowoff paths, the air blowoff openings are disposed at four places along four sides of the air suction opening;

corner panels that are respectively disposed at corner portions of the decorative panel, each of the corner panels being located between two adjacent air blowoff openings;

a human sensor for detecting a human body, wherein the human sensor is exposed at a specific corner panel of the corner panels;

wind guide paths that are concave grooves provided at the corner portions of the decorative panel, wherein the wind guide paths guide a part of the conditioned air, blown from the air blowoff openings, to the corner panels; and a first windbreak rib that is erected from the specific corner panel to suppress a direct strike on the human sensor by the conditioned air flowing from the wind guide paths toward the specific corner panel, wherein the first windbreak rib is formed continuously along a boundary portion between the specific corner panel and the wind guide path adjacent to the specific corner panel, and the first windbreak rib includes a vertical surface that is raised at a predetermined height from a panel surface of the specific corner panel, and an inclined surface that is inclined from a peak portion of the vertical surface toward a leading end portion of the specific corner panel, and a second windbreak rib that is an annular convex portion formed continuously along an edge of a sensor housing concave portion, wherein the human sensor is disposed in the sensor housing concave portion of the specific corner panel.

2. The ceiling-embedded air conditioner according to claim 1, wherein the specific corner panel has a thickness becoming smaller from a base end portion toward the leading end portion of the specific corner panel, and the first windbreak rib is disposed nearer the base end portion than the leading end portion of the specific corner panel.

3. The ceiling-embedded air conditioner according to claim 1, wherein the sensor housing concave portion is formed at a predetermined depth from the panel surface of the specific corner panel and in a predetermined position between a base end portion and the leading end portion of the specific corner panel, and the second windbreak rib is erected around the sensor housing concave portion to suppress the direct strike on the human sensor by the conditioned air flowing from the wind guide path adjacent to the specific corner panel toward the specific corner panel.

4. The ceiling-embedded air conditioner according to claim 2, wherein the sensor housing concave portion is formed at a predetermined depth from the panel surface of the specific corner panel in a predetermined position between the base end portion and the leading end portion of the specific corner panel, and the second windbreak rib is erected around the sensor housing concave portion to suppress the direct strike on the human sensor by the conditioned air flowing from the wind guide path adjacent to the specific corner panel toward the specific corner panel.

5. The ceiling-embedded air conditioner according to claim 1, wherein the first windbreak rib extends between the air blowoff openings adjacent to each other on the specific corner panel so that a direction of the conditioned air flowing from the wind guide path toward the specific corner panel is changed downwardly along the first windbreak rib.

6. The ceiling-embedded air conditioner according to claim 5, wherein the specific corner panel is inclined toward the casing main body from a base end portion to the leading end portion of the specific corner panel, and the human sensor is disposed at a position further from the turbo fan than the first windbreak rib so that the conditioned air from the wind guide path flows away from the human sensor.

7. The ceiling-embedded air conditioner according to claim 6, wherein the vertical surface and the inclined surface are integrally connected along the wind guide path adjacent to the specific corner panel, and the vertical surface and the inclined surface are connected at an acute angle to suppress the conditioned air from flowing toward the human sensor along the inclined surface.

* * * * *